US005864200A

United States Patent [19]

Tjaden et al.

[11] Patent Number: 5,864,200

[45] Date of Patent: Jan. 26, 1999

[54] METHOD FOR FORMATION OF A SELF-ALIGNED EMISSION GRID FOR FIELD EMISSION DEVICES AND DEVICE USING SAME

[75] Inventors: Kevin Tjaden, Boise; John K. Lee, Meridian, both of Id.

[73] Assignee: Micron Display Technology, Inc., Boise, Id.

[21] Appl. No.: 599,438

[22] Filed: Jan. 18, 1996

[51] Int. Cl.[6] ..... H01J 9/02

[52] U.S. Cl. ..... 313/309; 445/24

[58] Field of Search ..... 445/24, 50; 313/309, 313/495, 497

[56] References Cited

U.S. PATENT DOCUMENTS 5,302,238 4/1994 Roe et al. ..... 156/643

5,572,041 11/1996 Betsui et al. ..... 445/50

5,620,350 4/1997 Takemura ..... 445/50

*Primary Examiner*—Kenneth J. Ramsey

*Attorney, Agent, or Firm*—Hale and Dorr LLP

[57] ABSTRACT

According to the present invention, there is provided a method for forming an emitter grid in a substrate of a field emission display. In one embodiment of the invention, the method includes the step of forming an emitter in a trench in the substrate, the trench having a dimension which is substantially the same as a desired dimension of the emitter grid, disposing a dielectric layer on the substrate, and disposing a grid material layer on the dielectric layer. The field emission display is then planarized to expose a portion of the dielectric which contacts the emitter.

9 Claims, 8 Drawing Sheets

FIELD EMISSION DISPLAY
CROSS SECTION

METHOD FOR FORMATION OF A SELF-ALIGNED EMISSION GRID FOR FIELD EMISSION DEVICES AND DEVICE USING SAME

BACKGROUND OF THE INVENTION

This invention relates to the field of electronic displays, and, more particularly, field emission display ("FED") devices.

As technology for producing small, portable electronic devices progresses, so does the need for electronic displays which are small, provide good resolution, and consume small amounts of power in order to provide extended battery operation. Past displays have been constructed based upon cathode ray tube ("CRT") or liquid crystal display ("LCD") technology. However, neither of these technologies is perfectly suited to the demands of current electronic devices.

CRT's have excellent display characteristics, such as, color, brightness, contrast and resolution. However, they are also large, bulky and consume power at rates which are incompatible with extended battery operation of current portable computers.

LCD displays consume relatively little power and are small in size. However, by comparison with CRT technology, they provide poor contrast, and only limited ranges of viewing angles are possible. Further, color versions of LCDs also tend to consume power at a rate which is incompatible with extended battery operation.

As a result of the above described deficiencies of CRT and LCD technology, efforts are underway to develop new types of electronic displays for the latest electronic devices. One technology currently being developed is known as "field emission display technology." The basic construction of a field emission display, or ("FED") is shown in FIG. 1. As seen in the figure, a field emission display comprises a face plate 100 with a transparent conductor 102 formed thereon. Phosphor dots 112 are then formed on the transparent conductor 102. The face plate 100 of the FED is separated from a baseplate 114 by a spacer 104. The spacers serve to prevent the baseplate from being pushed into contact with the faceplate by atmospheric pressure when the space between the baseplate and the faceplate is evacuated. A plurality of emitters 106 are formed on the baseplate, which is often a semiconductor substrate. The emitters 106 are constructed by thin film processes common to the semiconductor industry. Millions of emitters 106 are formed on the baseplate 114 to provide a spatially uniform source of electrons.

Constructing the substrate, or baseplate, typically involves the use of a series of masks according to techniques commonly used in the semiconductor industry. However, it is desirable to form a substrate using as few masks as possible because each mask represents an additional cost which must be incurred. Moreover, an additional manufacturing step is required for each mask. These additional manufacturing steps also add to the cost of the finished product. For example, FIG. 1A shows a typical field emission display substrate 150 having emitters 156 formed thereon. Various masks are required for the formation of emitters 156. After the emitters are formed, an insulating layer 152 is deposited on the substrate 150. More masks are required to deposit and etch the insulating layer 152. Finally, in order to provide an electrical field for generating emissions, grid layer 154 is deposited on top of insulating layer 152. Again, masks must be used to deposit and etch grid layer 154 to finally obtain the device shown in FIG. 1A.

Further, it is crucial that the grid layer be accurately disposed on the substrate to avoid contacting the emitter, which would cause a short and thus destroy the emitter , or intruding into the path of the electrons which travel between the emitter and the faceplate. Accordingly, there is a need in the art for a field emission display which overcomes the above mentioned problems.

SUMMARY OF THE INVENTION

According to the present invention, a method for forming an emitter grid in a substrate of a field emission display ("FED") is provided. In one embodiment, the method comprises forming an emitter and a trench in the substrate, the trench having a dimension which is substantially the same as a desired dimension of the emitter grid, disposing a dielectric layer on the substrate, disposing a grid material layer on the dielectric layer, and planarizing the FED to expose a portion of the dielectric which contacts the emitter.

In another aspect of the invention, there is provided a field emission display comprising a substrate having a trench formed therein, a plurality of emitters formed in the trench, a dielectric layer disposed on the substrate and a grid material layer disposed on the dielectric layer.

BRIEF DESCRIPTION OF THE DRAWINGS

For a more complete understanding of the invention and for further advantages thereof, reference is made to the following Detailed Description taken in conjunction with the accompanying drawings, in which.

It is to be noted, however, that the appended drawings illustrate only typical embodiments of this invention and are therefore not to be considered limiting of its scope, for the invention may admit to other equally effective embodiments.

DETAILED DESCRIPTION OF EMBODIMENTS OF THE INVENTION

Figure 2:
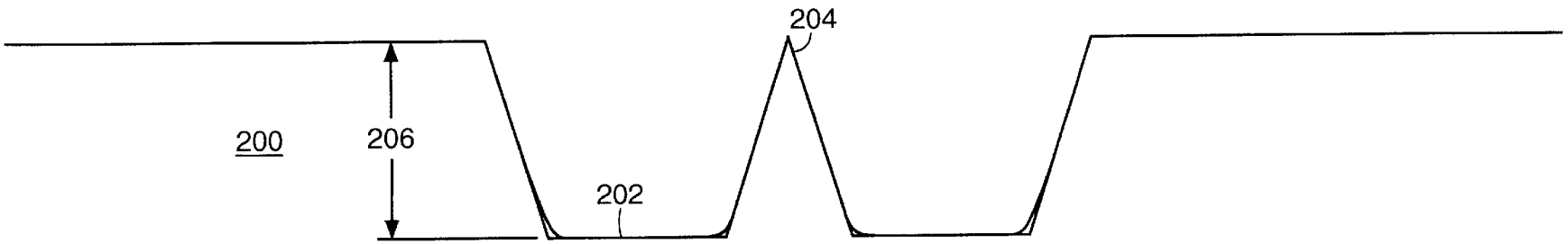
FIG. 2 is a plan view of a substrate for a field emission display according to an embodiment of the invention.

Referring now to FIG. 2, a method is provided for forming an emitter grid in a substrate of a field emission display ("FED") according to an embodiment of the invention.

In one embodiment, the method comprises forming an emitter 204 in a trench 202 in the substrate 200, the trench 202 having a dimension which is substantially the same as a desired dimension of the emitter grid. For example, in one aspect, the trench 202 is formed to have a depth 206 of approximately the same dimension as the height of the emitter 204. In another version of the invention, the length and/or width of the trench 202 is formed proportionally to the desired grid size. For example, in one embodiment, the trench is approximately several microns to several hundreds of microns in dimension.

The trench 202 may be formed according to any of several known techniques such as those described in U.S. Pat. No.

5,302,238, incorporated herein by reference. For example, the trench may be formed by plasma etching the substrate 200. Alternatively, the trench may be formed by wet chemical etching with, for example, a solution of nitric, acetic and hydrofluoric acids. Substrates 200 known to be useful for the present invention include silicon. Other examples of useful substrates include macrograin-poly, silicon carbide, and gallium arsenide. As shown, the trench 202 has formed therein an emitter 204. In one embodiment of the invention, the trench 202 and the emitter 204 are formed simultaneously in one processing step. In an alternate embodiment, the emitter 204 is formed in a separate step from the trench 202.

Figure 3:
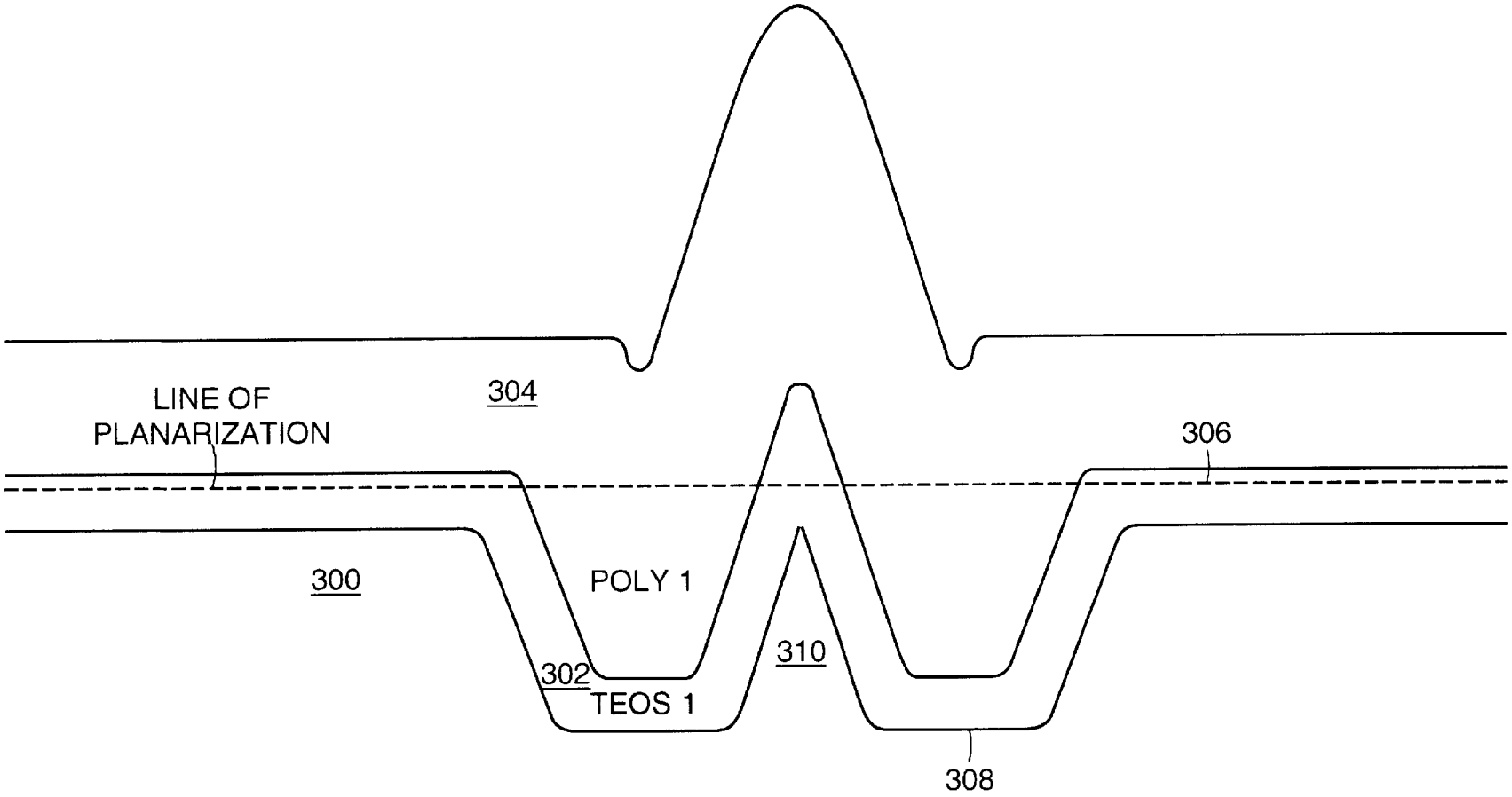
FIG. 3 is a plan view of a substrate for a field emission display according to a further embodiment of the invention.

After the trench 202 is formed as described above, further processing of the substrate 200 is described with respect to FIG. 3. FIG. 3 shows an embodiment of the invention having a substrate 300 which has been provided with a trench 308 having an emitter 310 formed therein. After the emitter 310 is formed, a dielectric layer 302 is disposed on the substrate 300. The dielectric layer 302 may be disposed on the substrate 300 by any of several techniques used in the industry. For example, chemical vapor deposition, ("CVD"), is one method known to be useful with the present invention for disposing dielectric layer 302 on substrate 300. Another method known to be useful for the present invention is thermal oxidation. The dielectric layer 302 is formed to be between about 0.2 and about 0.5 $\mu$m thick according to one version of the invention. An example of a dielectric material known to be useful with the present invention is tetraethylortho-silicate ("TEOS"), which is used form a layer including $SiO_2$. However, the type of dielectric used is not critical, and other examples of acceptable dielectrics will occur to those skilled in the art.

After the dielectric layer 302 is disposed on substrate 300, a grid material layer 304 is disposed on the dielectric layer 302. The grid material layer 304 is also disposed on the dielectric layer 302 according to any of several commonly used deposition techniques. For example, chemical vapor deposition. Other acceptable methods of disposing grid material 304 will occur to those of skill in the art. It should be appreciated that the grid material advantageously has a conductivity to meet the functionality requirements, for example line resistance. The conductivity may be controlled through well known techniques such as in-situ doping.

The grid material layer 304, according to one embodiment of the invention, is between about 0.5 and about 0.9 $\mu$m thick. An example of an acceptable grid material is polysilicon or "poly."

After the grid material layer 304 has been disposed, the substrate is then "planarized" along the line of planarization 306. Those of skill in the art will recognize that several methods of planarization will provide acceptable results when used with the present invention. For example, in one embodiment, a resist, or any other polymeric layer, is disposed on the grid material layer 304. This results in a smoothing of a new top surface of the substrate. The new surface can then be etched in a reactive plasma that etches the resist and grid material at the same rate. Another method of planarization known to be useful with the present invention is chemical/mechanical planarization, or "CMP."

Figure 4A:
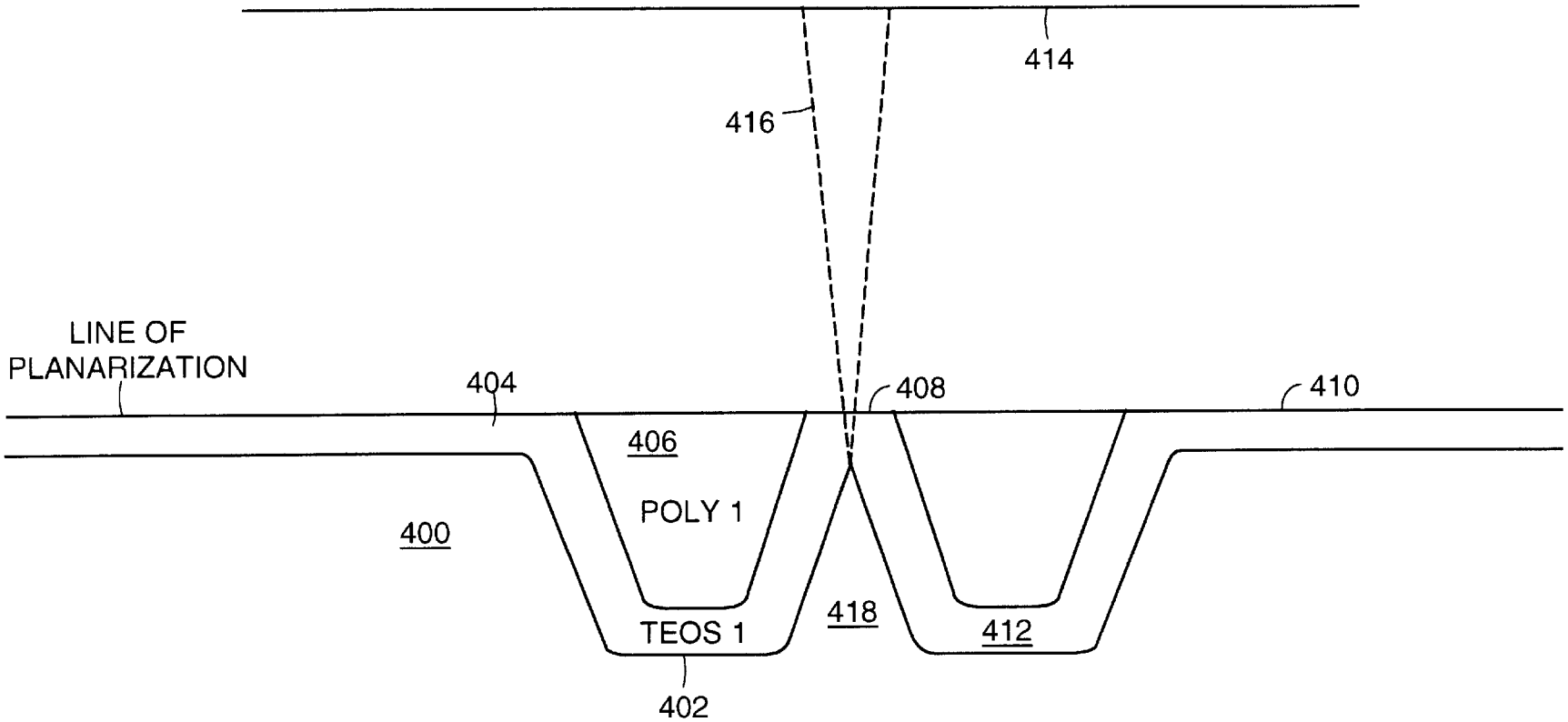
FIGS. 4A–4D show a field emission display according to embodiments of the present invention.

FIG. 4A shows a plan view of a substrate 400 after planarization. In this embodiment, the substrate 400 has a trench 402 with emitter 418 formed therein. Over the substrate 400 is disposed a dielectric layer 412. The remaining space inside the trench 400 is filled with grid material 406. As shown, substrate 400 has been planarized such that a portion 408 of the dielectric layer 412 covering, or superjacent, the emitter 418 is exposed at the surface of the grid material 406.

Figure 4B:
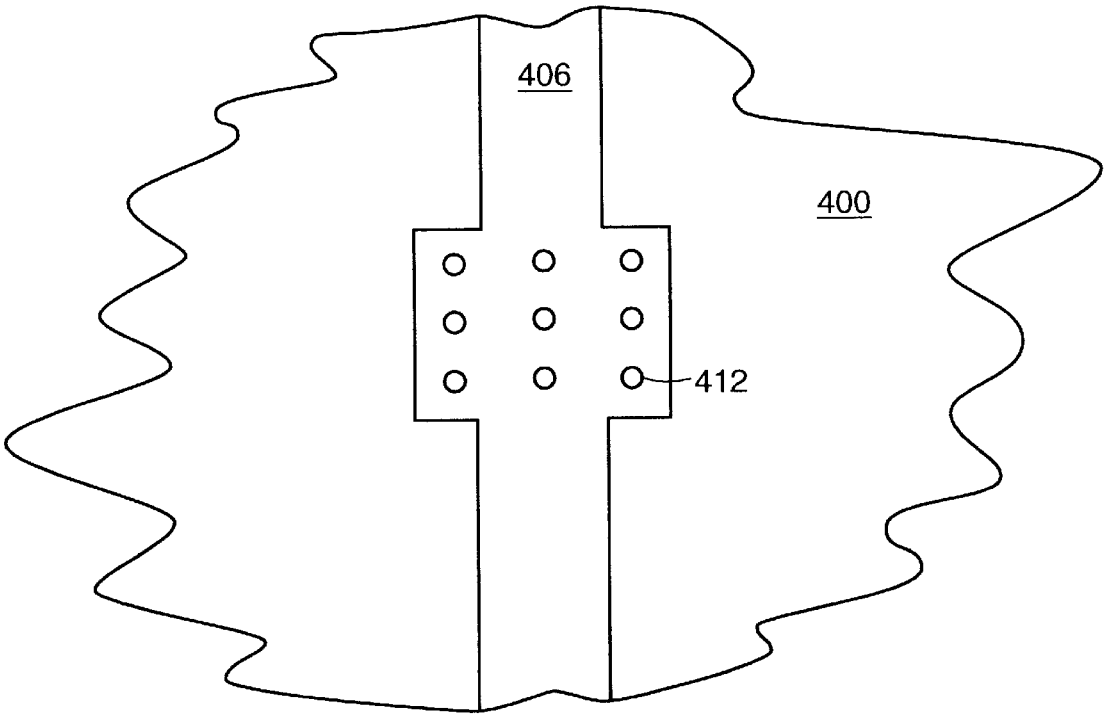
Figure 4C:
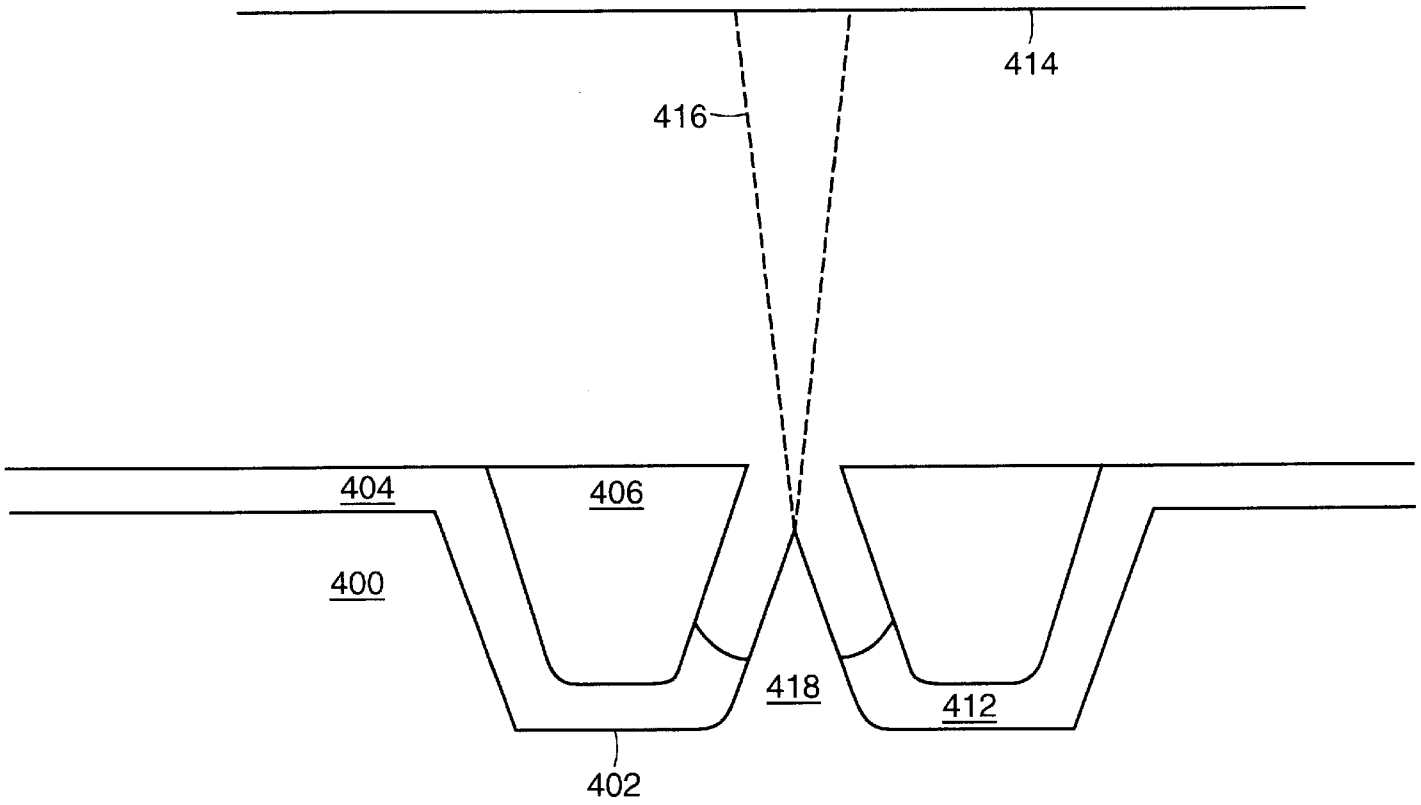

FIG. 4B is a top view of an embodiment of the invention after the planarization as described with respect to FIG. 4A. In this embodiment, the substrate 400 is shown with the layer of grid material 406 disposed thereon. The dielectric layer 412 covering the emitters 418 is exposed by the planarization as shown. With the dielectric layer 412 thus exposed, an etchant is applied to remove the dielectric 412 covering the emitters. FIG. 4C is a plan view of a substrate 400 after the etchant has been applied. As shown, the dielectric layer 412 has been removed to expose the emitter 418 while the grid material 406 remains in place. When an electric field is applied to the grid material 406 to activate emitter 418 there is now a clear path for electrons 416 to travel from the emitter 418 to the faceplate 414.

Figure 4D:
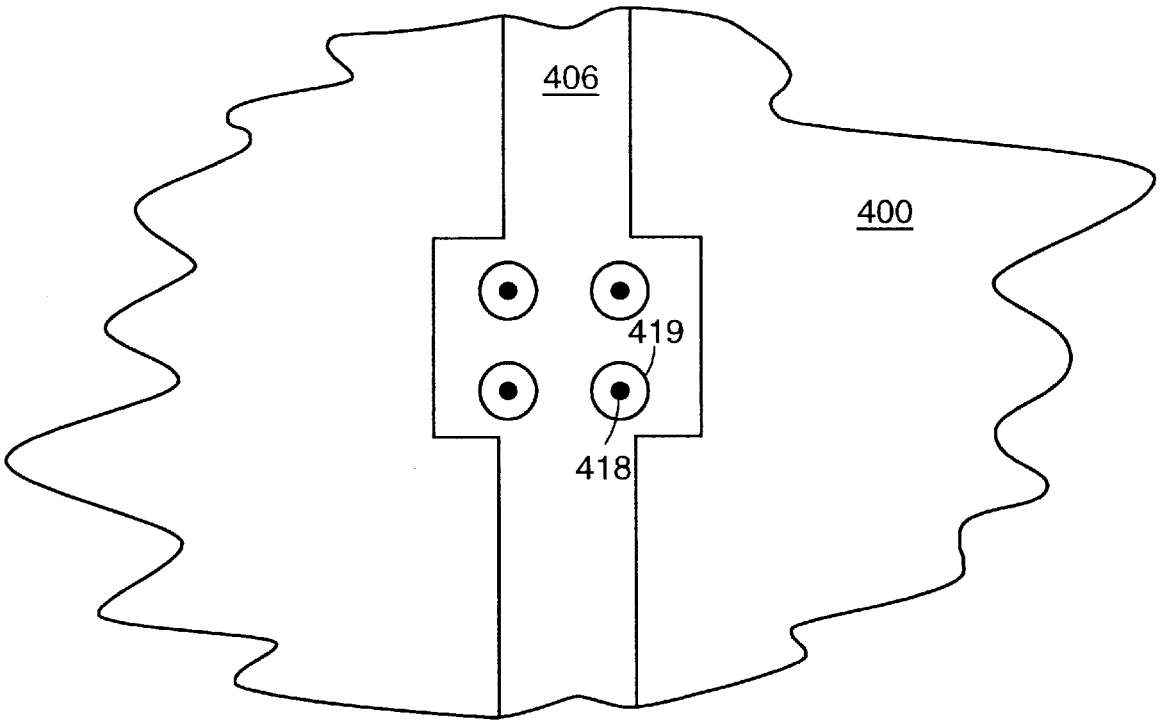

Since the dielectric layer 412 covering the emitter tip 418 protrudes through the grid material 406, and since it is the dielectric material 412 covering the emitter tip 418 which is etched away to expose the emitter tip 418, the emitter tip 418 will of necessity be aligned with the resulting opening in the grid material 406. Thus, this embodiment of the invention provides improved alignment between the emitters and the grid material. This is shown in FIG. 4D which is a top view of an embodiment of the invention, after the above-described etching. As shown, an emitter 418 is exposed and centrally aligned through an opening 419 formed in the grid material 406. Methods for etching the dielectric layer are known to those of skill in the art, and one example useful with the present invention is described in U.S. Pat. No. 5,302,238.

Figure 1:
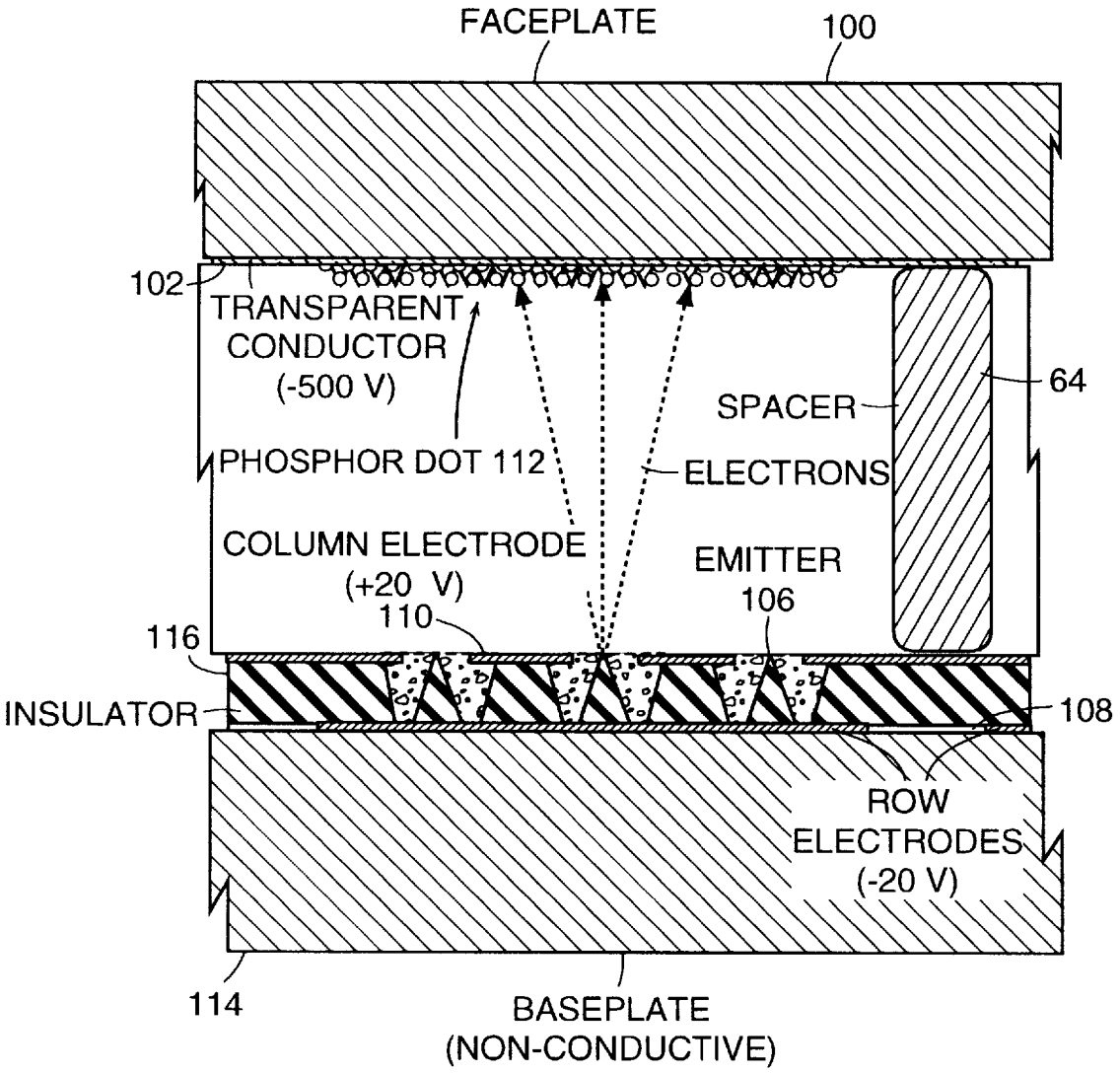
FIG. 1 is a plan view of a typical field emission display showing its operation.
Figure 1A:
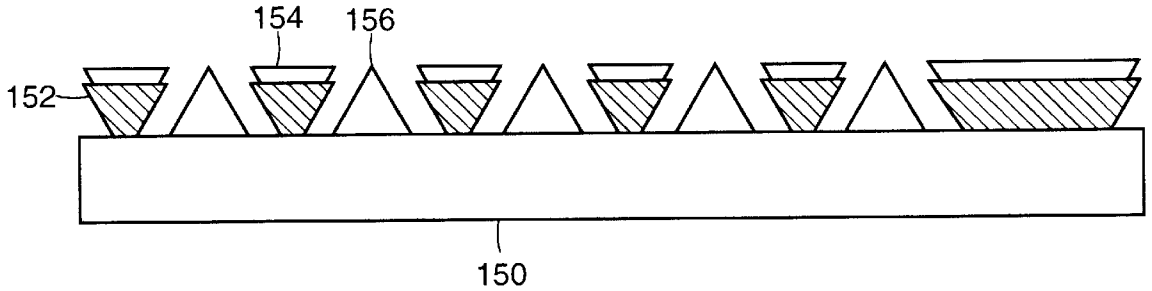
FIG. 1A is a plan view of a substrate of a field emission display.

In one version of the invention, the grid material 406 is conductive and operates as the column electrode 110 shown in FIG. 1. In other words, to activate the emitter 418 formed in the trench 402, a high voltage is applied to grid material 406. This generates an electric field between the grid material 406 and the emitter 418 causing the emissions of electrons 416. Consequently, it is possible to form an emitter grid without the necessity of disposing an additional conductive layer or patterning the grid material. This results in the ability to construct a field emission display without the need for a separate mask step to pattern the conductive layer.

Figure 5A:
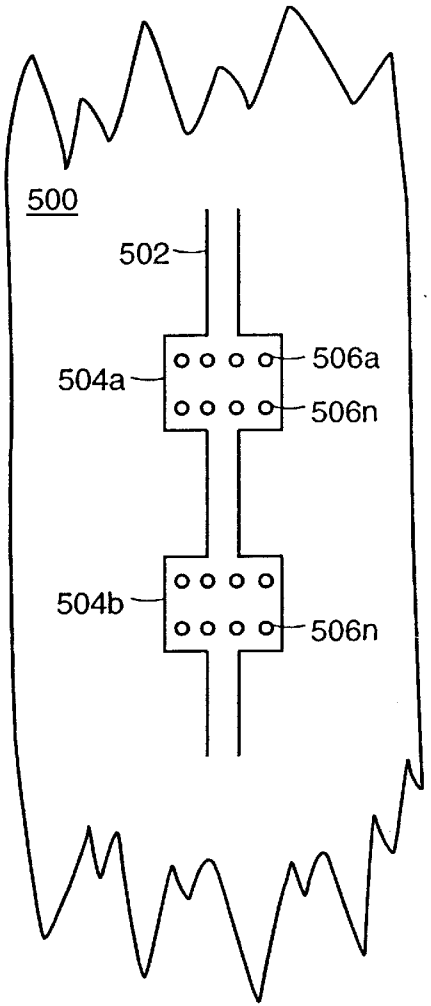
FIGS. 5A–5B are top views showing emitter grids formed according to an embodiment of the invention.
Figure 5B:
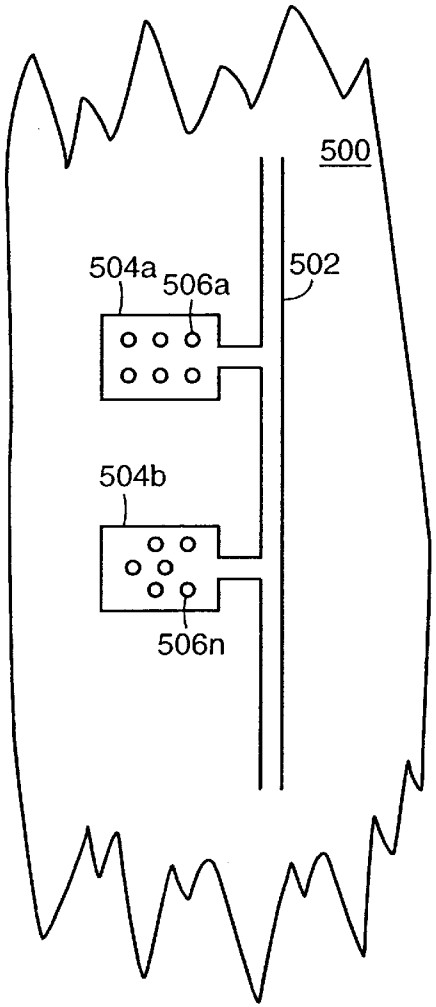

In addition to the above advantages, the present invention also allows the use of different emitter grid geometries. FIGS. 5A–5B are top views showing the construction of emitter grids according to different embodiments of the invention. FIG. 5A shows an embodiment in which a row having emitter grids 504*a* and 504*b* formed on a substrate 500. The emitter grids 504*a*–504*b* each contain a plurality of emitters 506*a*–506*n*. The emitter grids 504*a*, 504*b* are activated by address line 502, which is an extension of the grid material layer formed in the emitter grids 504*a* and 504*b*. Forming address line 502 is done by providing a channel in the substrate 500 which connects the grids 504*a*, 504*b*. Since the grid material is disposed in the channel, it will not be removed during planarization. This allows emitter grids 504*a*, 504*b* to be activated by attaching a high voltage to address line 502. No separate metal line is required to address the emitter grids. FIG. 5B shows another example of the present invention in which emitter grids 504*a* and 504*b* are disposed on substrate 500. In this embodiment, the address line 502 is placed along one side of the emitter grids 504*a*, 504*b*. Again, the need for providing a separate metal layer to address the grids 504*a*, 504*b* is avoided. FIGS. 5A and 5B are just two examples of possible geometries, and other geometries will occur to those of skill in the art.

Moreover, it should be noted that the emitters 506*a*–506*n* are self-aligned. In other words, since the emitter grids are formed by planarizing the substrate to expose the tips of the emitters, or at least the dielectric layer covering the tips of the emitters, through the grid material 502 the present invention ensure that the emitters will be aligned such that no interference is provided from the grid material layer.

Referring again to FIG. 4, in another aspect of the invention, there is provided a field emission display which comprises a substrate 400 having a trench 402 formed therein, an emitter 418 formed in the trench 402, a dielectric layer 412 disposed on the substrate 400, and a grid material layer 406 disposed on the dielectric layer 412. According to a further embodiment of the invention, a portion of the dielectric material 408 in contact with the emitter 418 is exposed through the grid material layer 406. Those of skill in the art will recognize that other embodiments are possible, which allow the emissions from emitter 418 to travel to the faceplate 414 without substantial interference from grid material 406.

What is claimed is:

1. A method for forming an emitter grid in a substrate of a field emission display ("FED"), the method comprising:

forming a trench in the substrate, the trench having a dimension which is substantially the same as a desired dimension of the emitter grid, said trench having an emitter therein;

disposing a dielectric layer on the substrate;

disposing a grid material layer on the dielectric layer;

planarizing the FED to expose a portion of the dielectric which covers the emitter;

etching the exposed dielectric to expose the emitter.

2. A method as in claim 1 wherein disposing a dielectric layer on the substrate comprises disposing a layer of tetra-ethylortho silicate.

3. A method as in claim 1 wherein disposing a dielectric layer comprises disposing a layer of SiO2.

4. A method as in claim 1 wherein disposing a grid material layer comprises disposing a layer of polysilicon.

5. A method as in claim 1 wherein planarizing comprises CMP.

6. A method for forming a row of emitter grids in a substrate of a field emission display ("FED"), the method comprising:

forming a plurality of trenches in the substrate, each trench having a plurality of emitters formed therein and a dimension which is substantially the same as a desired dimension of an emitter grid, the trenches being connected by a channel;

disposing a dielectric layer on the substrate;

disposing a grid material layer on the dielectric layer;

planarizing the FED to expose a portion of the dielectric which covers the emitters in each emitter grid;

etching the exposed portion of the dielectric to expose the emitters.

7. A field emission display comprising:

a substrate having a trench formed therein;

a plurality of emitters formed in the trench;

a dielectric layer disposed on the substrate wherein the emitters protrude through the dielectric layer; and a grid material layer disposed on the dielectric layer.

8. A field emission display as in claim 7, wherein a portion of the dielectric material contacting the emitters is exposed through the grid material layer.

9. A field emission display as in claim 7, wherein the grid material is disposed such that electrons emitted by the emitters do not strike the grid material layer.

* * * * *